US006840320B2

(12) United States Patent
Dewey et al.

(10) Patent No.: US 6,840,320 B2
(45) **Date of Patent: *Jan. 11, 2005**

(54) METHOD AND APPARATUS FOR FORMING AN OPTIMIZED WINDOW

(75) Inventors: Charles H. Dewey, Houston, TX (US); Brian William Cruickshank, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 40 days.

This patent is subject to a terminal disclaimer.

(21) Appl. No.: 10/314,705

(22) Filed: Dec. 9, 2002

(65) Prior Publication Data

US 2003/0102129 A1 Jun. 5, 2003

Related U.S. Application Data

(63) Continuation-in-part of application No. 09/288,401, filed on Apr. 8, 1999, now Pat. No. 6,499,538.

(51) Int. Cl.[7] ..... E21B 29/06
(52) U.S. Cl. ..... 166/297; 166/117.5; 166/55.3
(58) Field of Search ..... 166/50, 55.3, 117.5, 166/117.6, 297, 298

(56) References Cited

U.S. PATENT DOCUMENTS

| | | | | |
|---|---|---|---|---|
| 2,882,015 A | | 4/1959 | Beck | |
| 5,113,938 A | | 5/1992 | Clayton | |
| 5,427,179 A | * | 6/1995 | Bailey et al. | 166/117.6 |
| 5,467,820 A | | 11/1995 | Sieber | |
| 5,522,461 A | | 6/1996 | Carter et al. | |
| 5,676,206 A | | 10/1997 | Rehbock et al. | |
| 5,771,972 A | | 6/1998 | Dewey et al. | |
| 5,816,324 A | | 10/1998 | Swearingen et al. | |
| RE36,526 E | | 1/2000 | Braddick | |
| 6,012,516 A | | 1/2000 | Brunet | |
| 6,499,538 B2 | | 12/2002 | Dewey et al. | |
| 2003/0183388 A1 | * | 10/2003 | Toulouse et al. | 166/298 |

FOREIGN PATENT DOCUMENTS

| | | |
|---|---|---|
| GB | 2 310 231 A | 3/1997 |
| GB | 2 312 702 A | 11/1997 |
| GB | 2 313 391 A | 11/1997 |
| GB | 2 348 898 | 10/2000 |
| WO | WO97/27380 | 7/1997 |

* cited by examiner

*Primary Examiner*—Zakiya Walker
(74) *Attorney, Agent, or Firm*—Conley Rose, P.C.

(57) ABSTRACT

Methods and apparatus are described for forming a window of optimum dimensions in casing wall. A window of maximum width is cut when the center line of the mill tool is located inside of the inner diameter of the casing where a maximum amount of casing is drilled away by the mill tool. A whipstock is described which deviates the mill tool outwardly so that the center line of the mill tool is in approximately this position. The whipstock then maintains the mill tool at this approximate location until a window of desired length is cut having a substantially maximum width. The whipstock then deviates the mill tool such that the centerline is outside of the casing to drill a rathole into the formation.

28 Claims, 9 Drawing Sheets

METHOD AND APPARATUS FOR FORMING AN OPTIMIZED WINDOW

CROSS-REFERENCE TO RELATED APPLICATIONS

This application is a continuation-in-part of U.S. patent application Ser. No. 09/288,401 filed Apr. 8, 1999, now U.S. Pat. No. 6,499,538 hereby incorporated herein by reference.

STATEMENT REGARDING FEDERALLY SPONSORED RESEARCH OR DEVELOPMENT

Not applicable.

BACKGROUND OF THE INVENTION

1. Field of the Invention

The present invention relates to methods and apparatus for cutting or milling a window in a cased borehole so that a secondary or deviated borehole can be drilled. More particularly, the invention relates to methods and apparatus for forming a window of optimal dimensions. Still more particularly, the invention relates to methods and apparatus for deviating a mill tool radially outwardly from an optimal cutting position to a location outside of the casing.

2. Description of the Related Art

It is common practice to use a whipstock and mill arrangement to help drill a deviated borehole from an existing earth borehole. The whipstock is set on the bottom of the existing earth borehole or anchored within the borehole. The whipstock has a ramped surface that is set in a predetermined position to guide a mill in a deviated manner so as to mill away a portion of the wellbore casing, thus forming a window in the steel casing of the borehole.

The typical whipstock presents a ramped surface which has a substantially uniform slope such as three degrees from the vertical. Thus, the mill tool is normally urged outwardly at a constant rate until it is fully outside of the casing. As the mill moves downward within the borehole, the ramped surface of the whipstock urges the mill radially outwardly so that the cutting surface of the mill engages the inner surface of the casing. As this engagement begins to cut into the casing, the casing is worn away and then cut through, thus beginning the upper end of the window. The ramp of the whipstock then causes further deviation of the mill, causing the mill to move downwardly and radially outward through the casing itself. Thus, a longitudinal window is cut through the casing. Ultimately, the whipstock's ramped surface urges the mill radially outwardly to the extent that it is located entirely outside of the wellbore bore casing. Once this occurs, the mill ceases cutting the window. This traditional cutting technique results in an upside-down "teardrop" shaped window which has a section of maximum width located close to the top of the window. From this section of maximum width, the width of the window decreases and the window tapers as the lower portion of the window is approached. An example of such a window is shown in prior art FIG. 1.

Once the window is cut in the manner described above, a deviated borehole is then cut using a point of entry that is proximate the teardrop-shaped window. Unfortunately, the teardrop shape of the window can impede the ability to drill the deviated borehole. Specifically, as the window narrows, the metal portion of the casing interferes with the ability to drill, place liners and so forth.

Thus, a need exists for methods and devices that can be employed to form a window in a casing wall that has optimum or near optimum dimensions so that subsequent directional drilling efforts are not hindered.

BRIEF SUMMARY OF THE INVENTION

The invention provides methods and apparatus for forming a window of optimum dimensions in casing wall. The inventor has recognized that a window of maximum width is cut when the center line of the mill tool is located a distance inside of the inner diameter of the casing where a maximum amount of casing is drilled away by the mill tool. A whipstock is described which deviates the mill tool outwardly so that the center line of the mill tool is in approximately this position. The whipstock then maintains the mill tool at this approximate location until a window of desired length is cut having a substantially maximum width. Once the window is formed, the mill tool is deviated radially outwardly through the window to a location outside of the casing. Other objects and advantages of the present invention will appear from the following description.

BRIEF DESCRIPTION OF THE DRAWINGS

For a detailed description of the preferred embodiment of the invention, reference will be made to the accompanying drawings wherein.

DETAILED DESCRIPTION OF THE PREFERRED EMBODIMENTS

Figure 1:
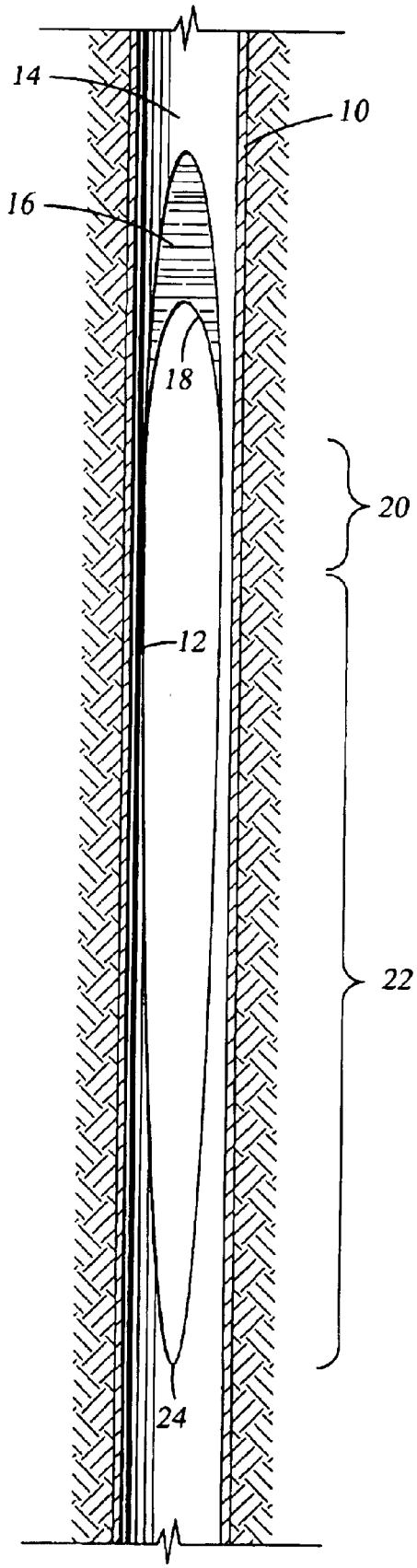
Fig. 1 (PRIOR ART)
FIG. 1 is a cross-sectional view of a borehole depicting a typical "teardrop shaped" window of the type cut by conventional whipstock and mill arrangement.

Referring first to prior art shown in FIG. 1, a standard wellbore casing 10 is depicted having a milled window 12. As is apparent, the inner surface 14 of the casing 10 is shown. At the upper portion of the window 12 is milled away portion 16 which has resulted from initial engagement of a mill tool with the inner surface 16. The upper end 18 of the window 12 tapers outwardly to a maximum width. It should be understood that the term "width" refers to the lateral distance between the two edges of the window. Conversely, the term "length" refers to the distance from the top edge to the bottom edge of the window. The window provides a section 20 of substantially maximum width. It can be appreciated that the section of maximum width occurs near the top edge 18 of the window 12. The lower section of the window 12 presents a tapered portion 22 which narrows in width until the lower edge 24 is reached.

Figure 2A:
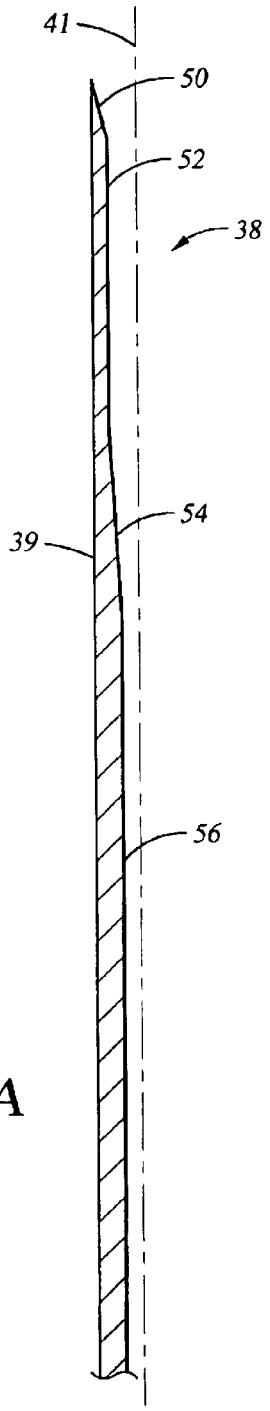
FIGS. 2A and 2B are cross-sectional illustrations of an exemplary whipstock constructed in accordance with the present invention.
Figure 2B:
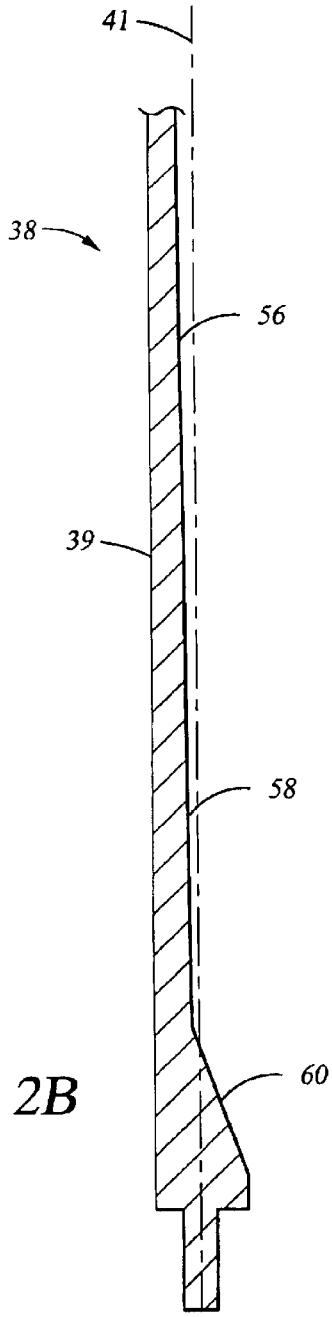

FIGS. 2A and 2B illustrate an exemplary whipstock 38 constructed in accordance with the present invention. The whipstock 38 has an elongated whipstock body 39 having a longitudinal axis as represented by the reference line 41. The whipstock 38 presents a series of mill engagement faces made up of a composite of slanted portions. It should be noted that the values provided for distances and angular slopes are exemplary only and are not intended to be limiting. Generally, the inventive whipstock 38 is thinner along the majority of its length than typical conventional whipstocks. The upper end of the whipstock 38 presents a first sloped surface 50 having a fifteen degree angle from the axis 41. Below that, a second sloped surface 52 is angled at essentially zero degrees from the axis 41. This second surface continues downwardly along the length of the whipstock 38 for approximately two feet. Immediately below the second surface, a third sloped surface 54 is provided having an angle of three degrees from the axis 41.

A maintenance surface 56 is provided below the three degree surface. The maintenance surface engages the mill tool 30 as shown in FIG. 3C and maintains it substantially in an optimal position to allow the mill tool 30 to cut a window of substantially maximum width within the casing 32. The maintenance surface 56 has a length which is approximately equal to the desired length for a window of substantially maximum width. The maintenance surface 56 forms an angle of zero degrees with the axis 41. As a result, a mill engaging the maintenance surface 56 will not be urged outwardly through the casing as it moves downwardly through the wellbore. Below the maintenance surface 56, a fourth sloped surface 58 is provided which is angled at approximately one degree from the axis 41. Finally, a lower sloped portion 60 of the whipstock 38 provides a fifteen degree sloped surface from the axis 41.

Figure 6:
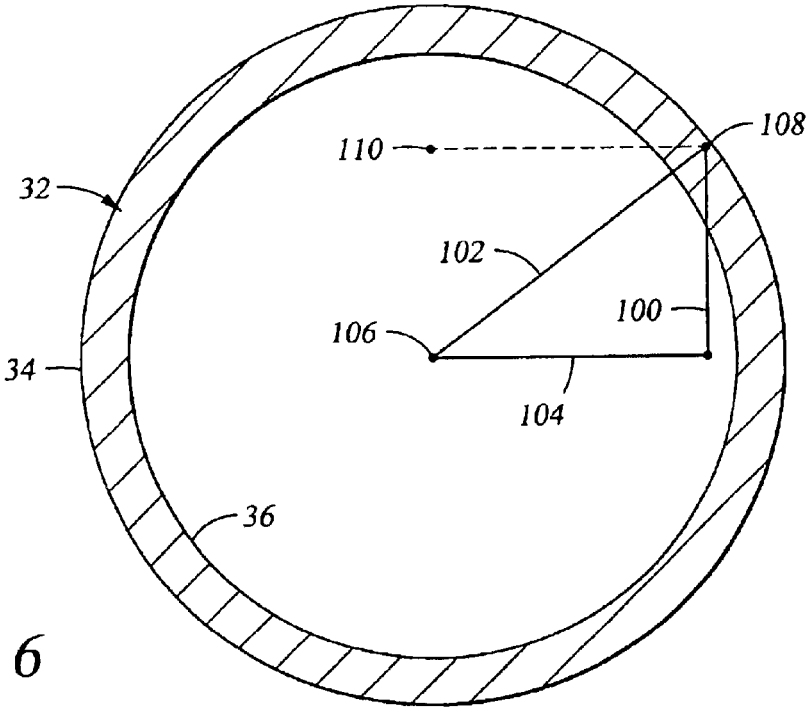
FIG. 6 graphically depicts the relationship between casing radius, mill radius and an optimum mill displacement.

As noted, the invention capitalizes upon the inventor's recognition that a window's width is maximized when the center line of the mill tool is located inside of the inner diameter of the casing, as previously described. An optimal mill displacement (OMD) distance 100 can be determined if the casing radius (CR) 102 and the milling radius (MR) 104 are known. The relationship is also depicted graphically in FIG. 6. The optimal mill displacement distance 100 is the desired amount of movement of the center of the mill tool 30 from the central axis 106 of the casing 32. The casing radius 102 is the distance from the central longitudinal axis 106 of the casing to a point 108 on or within the diameter of the casing 32. In other words, the casing radius 102 may be measured from the inner surface 36 or the outer surface 34 of the casing 32 as well as any point in between the inner and outer surfaces as shown in FIG. 6. The milling radius 104 is the radius presented by the lead mill 68 of the mill tool 30. These distances are related mathematically according to the following equation: $OMD=\sqrt{(CR)^2-(MR)^2}$. Once an optimum mill displacement distance 100 is determined, the mill tool 30 is displaced that distance so that the mill axis 42 is moved to a desired displacement location 110 depicted in FIG. 6.

Referring now to FIGS. 3A–3F, a side cross-sectional view is shown of a portion of a wellbore wherein the steel casing 32 is disposed within a cement liner 62 and disposed through an earth formation 64. The casing 32 contains the whipstock 38 constructed in accordance with the present invention. Also shown, progressively milling a window, is the mill tool 30. The mill tool 30 includes a central shaft 66 with a lead mill 68 and follower mill 70 (visible in FIG. 3C). It should be understood that the design and precise components of the mill 30 may be varied.

The milling diameter (d) of the mill tool 30 is typically established by the diameter of the lead mill 68. The follower mill 70 may have the same approximate milling diameter although other components of the milling tool are smaller in diameter. It is generally desired to have the milling diameter as large as is operationally possible within the casing 32. Therefore, the milling diameter is typically set at or around the drift diameter for the wellbore casing 32.

Figure 3A:
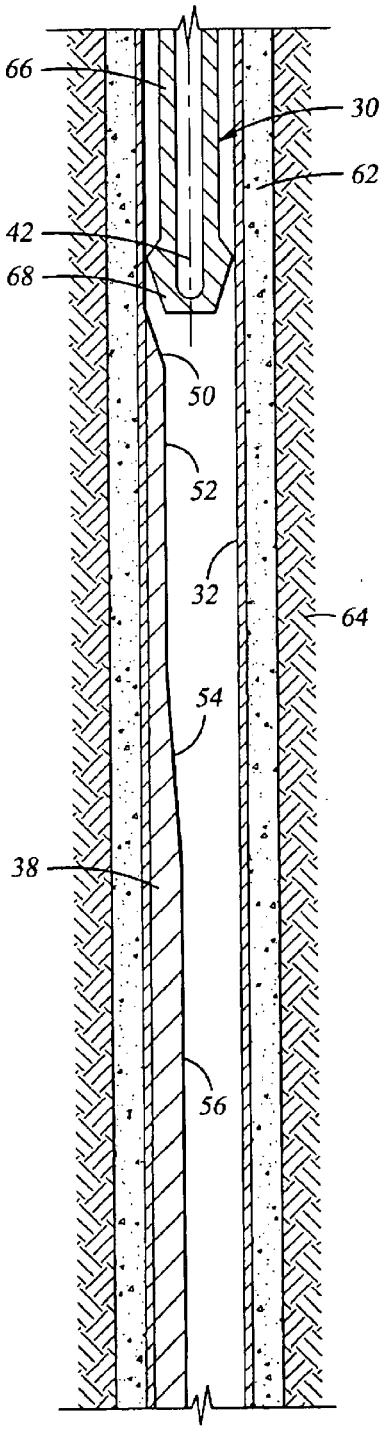
FIGS. 3A–3E are cross-sectional depictions of an exemplary milling operation using the whipstock shown in FIGS. 2A and 2B.
Figure 3B:
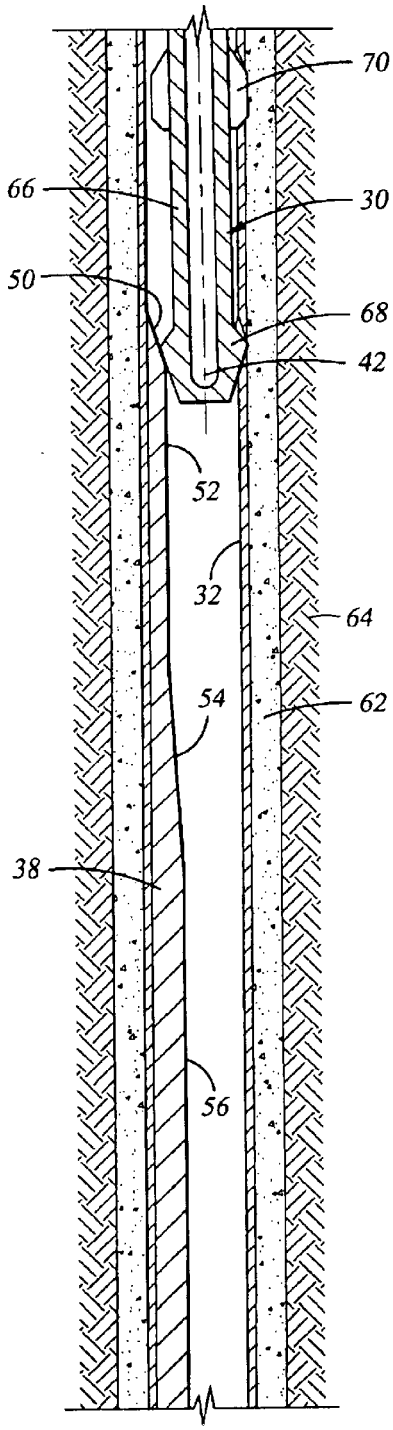
Figure 3C:
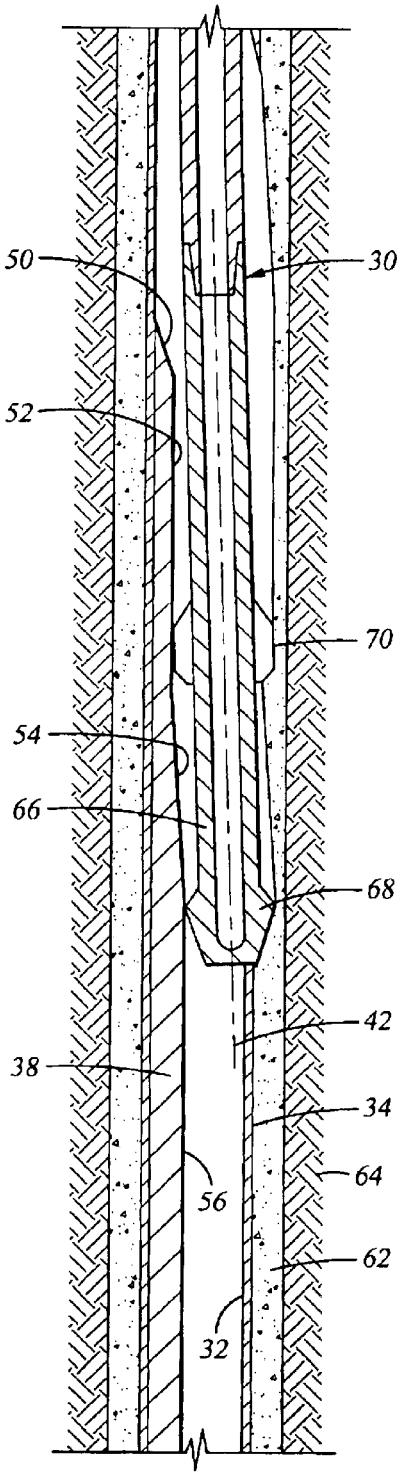

In FIG. 3A, the mill 30 is being lowered through the center of the casing 32. In FIG. 3B, the lead mill 68 engages the first sloped surface 50 and is deviated outwardly so that the casing 32 begins to be milled away.

In FIG. 3C, the mill 30 has moved downwardly to the extent that the lead mill 68 of the mill tool 30 engages the maintenance surface 56 of the whipstock 38. The axis 42 of the mill tool 30 is disposed within the inner diameter of the casing 32, and the diameter of the mill tool 30 is substantially aligned with the outer surface 34 of the casing 32 (see FIG. 4). As the mill tool 30 is moved further downwardly within the borehole, it will continue to travel along the maintenance surface 56 and be maintained in substantially the same relationship of distance between the axes of the mill tool 30 and wellbore. Ultimately, the mill tool 30 will engage the lower sloped surface 60, causing the mill tool 30 to be deviated outwardly through the casing 32, thus completing the window cutting operation.

Figure 3D:
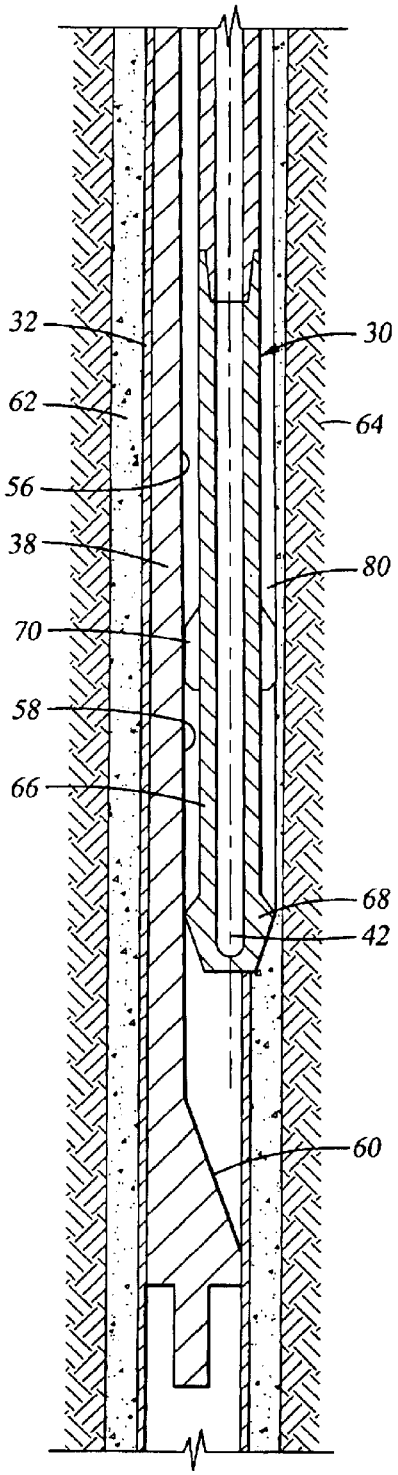
Figure 3E:
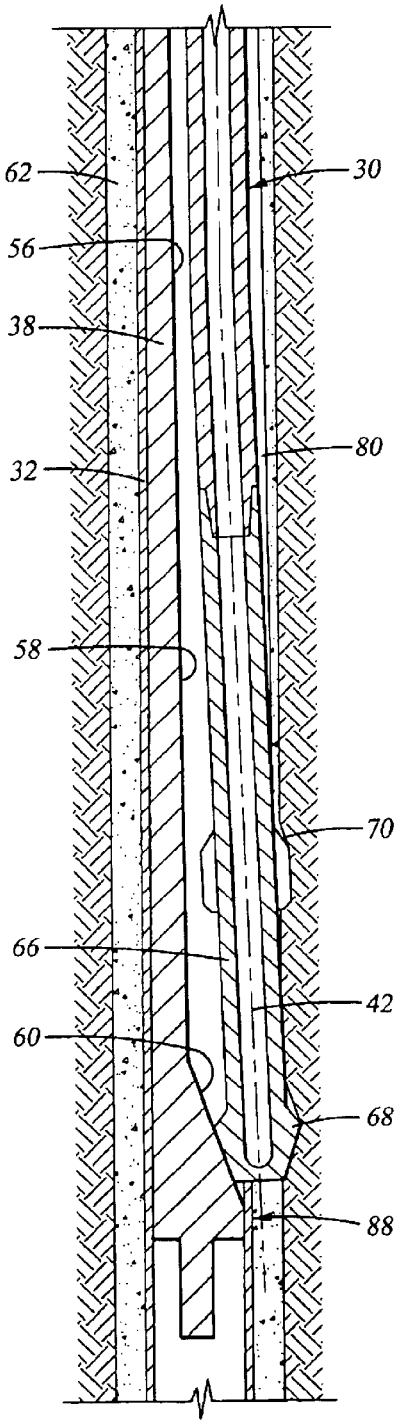

FIGS. 3D and 3E depict the portion of the wellbore in which the lower portion of the whipstock 38 is located and help illustrate the cutting of the lower end 88 of the window 80. The window 12 has been cut as the lead mill 68 engaged and moved along the maintenance surface 56. In FIG. 3D, the lead mill 68 engages and travels along the slightly outwardly-deviated surface 58 on the whipstock 38, thus urging the mill 30 outwardly away from its optimal cutting position and allowing the window 80 to begin narrowing in width.

In FIG. 3E, the lead mill 68 has engaged the lowest sloped surface 60 whereupon the mill tool 30 is being urged radially outwardly beyond the casing 32. At this point, the central axis 42 of the mill 30 crosses the wall of the casing 32 and the width of the window 80 will be smaller still, until the lower end 88 of the window is cut at the approximate location shown in FIG. 3E. Because engagement of the mill 30 with the engagement surfaces 58 and 60 will cause the window 80 to narrow in width, it is preferred that these surfaces be quite small in longitudinal distance as compared to the maintenance surface 56, thereby permitting the window 80 to have a shape substantially like that shown in FIG. 5.

Figure 5:
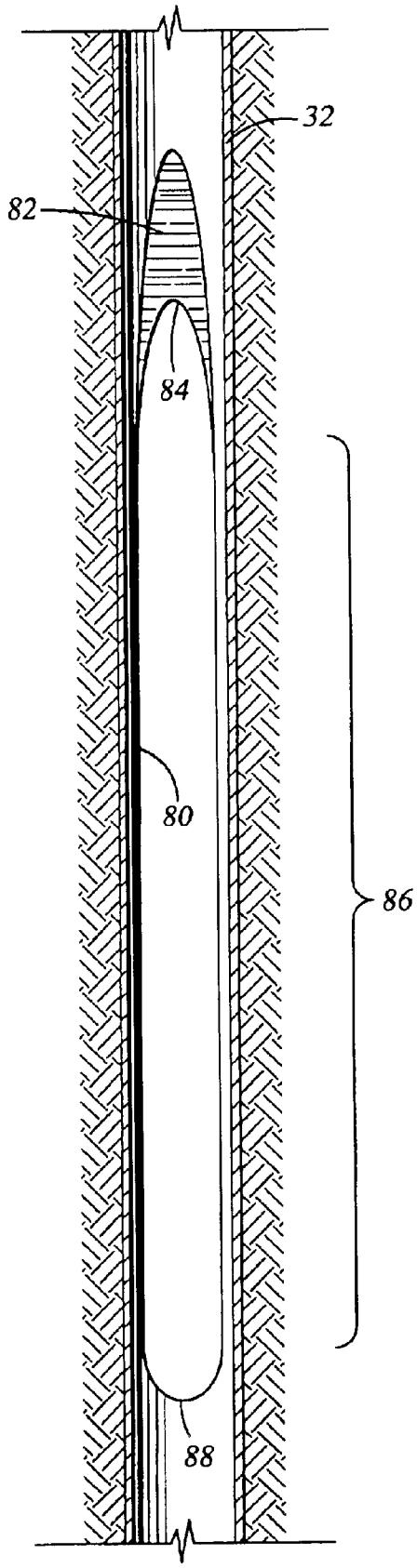
FIG. 5 is a cross-sectional view of a borehole casing depicting an exemplary optimized window which might be cut using the methods and apparatus of the present invention.

As a result of the method of cutting described, a window is drilled having virtually maximum width for a predetermined length. FIG. 5 depicts an exemplary window 80 of this type. The window 80 features a milled upper portion 82. Proximate its top end 84, the window 80 widens outwardly and provides a section of substantially maximum width 86 that extends nearly the entire length of the window 80. The window 80 is optimized in the sense that it provides a substantially maximum width along a significant portion of its length. The window has a larger than normal width in its lower half rather than a narrowed tapering shape. As a result, it is easier to create a deviated borehole through the lower portion of the window.

The top end 84 of the window 80 will be cut as the lead mill 68 engages and moves along the upper ramp 50. The lower end 88 of the window 80 will be formed when the lead mill 68 engages the lower sloped surface 60. It will be understood that the maximum width portion of the window 80 may be made to be essentially any length desired by making the maintenance surface 56 of a corresponding length.

Figure 4:
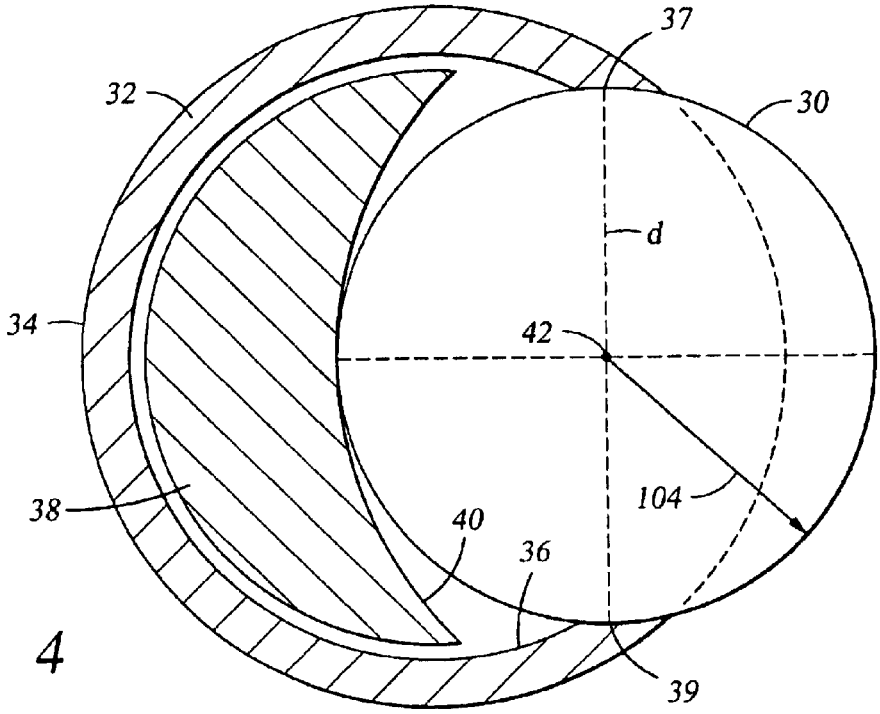
FIG. 4 is a top cross-sectional view of a mill tool, whipstock and casing.

FIG. 4 depicts, through a top cross-sectional view, the approximate desired location for a mill tool 30 with respect to wellbore casing 32 in order to achieve maximum cutting away of the casing wall. Casing 32 represents a steel casing which is cylindrical in shape. The casing wall presents an outer surface 34 and an inner surface 36. Also shown in FIG. 4 is a whipstock 38 having a mill engagement face 40. The mill tool 30 is shown as cutting through the wall of the casing 32. The mill tool 30 has a central axis, shown at 42. As illustrated, the axis 42 of the mill tool 30 is located inside of the inner surface 36 of the casing 32. In addition, the diameter (d) of the mill tool 30 is shown to be intersecting the wall of the casing 32 at two points 37, 39.

Figure 7A:
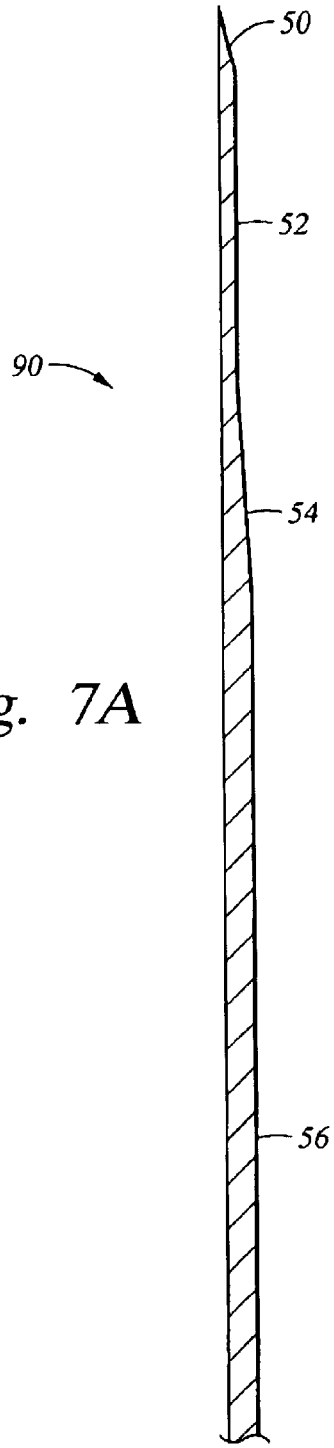
FIGS. 7A and 7B illustrate an alternative design for a whipstock constructed in accordance with the present invention.
Figure 7B:
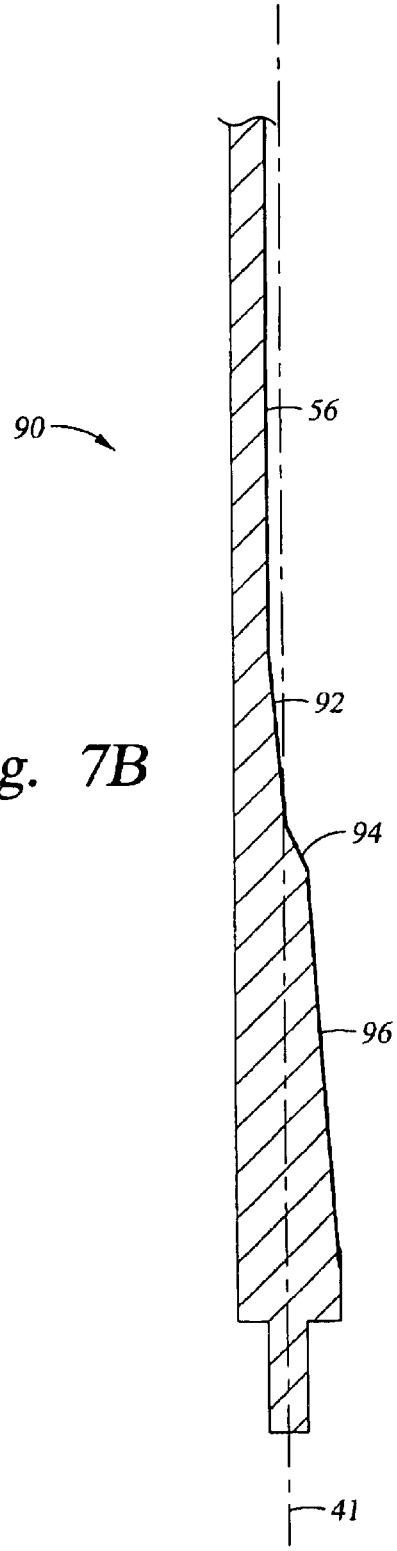

FIG. 7 depicts an alternative whipstock design 90 that might be used in accordance with the present invention. For most of its length, the alternative whipstock 90 is constructed in a manner similar or identical to the initial whipstock 38. Because of the similarities, like reference numerals are use for like components. The upper engagement surfaces of the whipstock 90 are the same as those of the whipstock 32 described previously. Further, an elongated maintenance surface 56 is provided which forms an angle of approximately 0 degrees with the vertical axis 41. Below the maintenance surface 56, are sloped surfaces 92, which forms an angle of approximately 3 degrees with the axis 41, 94, which forms an angle of approximately 15 degrees with the axis 41, and 96, which forms an angle of approximately 3 degrees with the axis 41. The lower surfaces 92, 94 and 96 serve to progressively ramp the mill 30 outward from the maintenance surface 56 until the central axis of the mill is moved radially outside of the casing and the lower end of the window 80 is cut.

Figure 8:
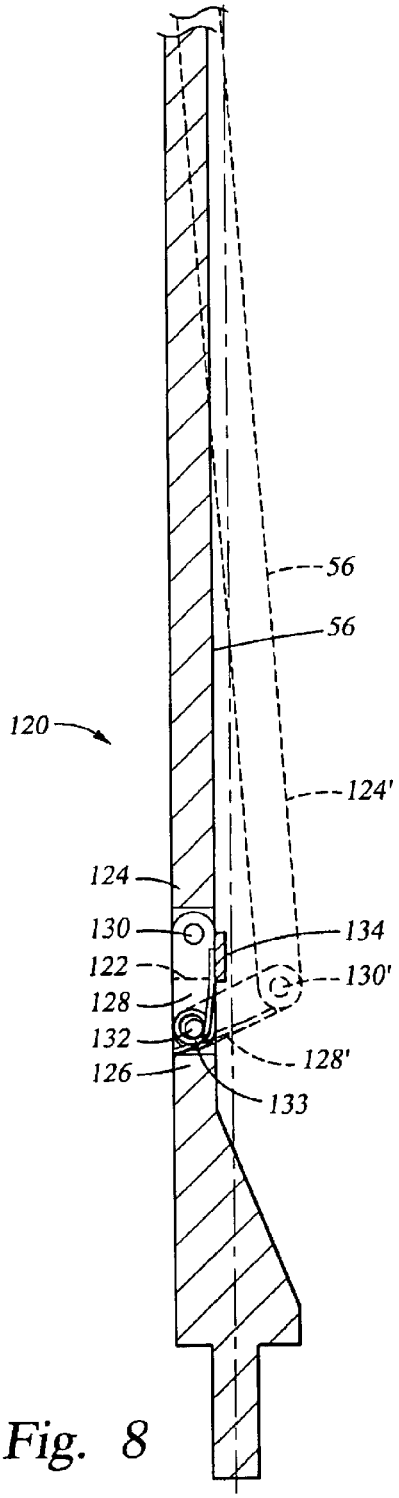
FIG. 8 depicts an exemplary actuatable ramp which can be used to urge the mill tool radially outside of the casing after an optimized window has been cut.

In a further alternative embodiment of the invention, depicted in FIG. 8, an actuated ramp is used to deviate the mill tool radially outward from proximate its optimal cutting position to a location outside of the casing. FIG. 8 shows the lower end of a whipstock 120. The upper portion of the whipstock (not shown) will substantially resemble in construction the whipstock 38 previously described. Maintenance surface 56 is provided which forms an angle of approximately 0 degrees with the central axis of the whipstock, as previously described. The body of the whipstock 120 is divided at 122 so that an upper portion 124 and a lower portion 126 are provided. The upper and lower portions 124, 126 are interconnected by a linkage 128 that provides a pair of pivot points 130, 132. The lower pivot 132 is biased by a torsional spring 133 so that the linkage 128 can be moved outwardly to an angled position, shown as 128', and carry the upper portion 124 of the whipstock 120 outward to the position shown as 124'. A securing member 134 is attached to the whipstock 120 proximate the linkage 128 so that the torsional spring is restrained against moving the upper portion 124 of the whipstock 120 to the position 124'. The securing member 134 may comprise a metal plate or shank that is bolted in place on the whipstock 120. Alternatively, a collar or clamp might be used.

In operation, a mill tool, such as mill 30, will travel along the maintenance surface 56 and, upon encountering the securing member 134, will mill the securing member 134 away, thereby actuating a ramp formed by the upper portion 124 of the whipstock 120 as it is moved with respect to the lower portion 126. The upper portion 124 of the whipstock 120 will be moved to, or toward, the location shown at 124' by the torsional spring when the mill is pulled uphole. As a result, the mill tool will be deviated radially outwardly away from its optimal milling position and allow a rathole to be cut on a subsequent pass.

Figure 9A:
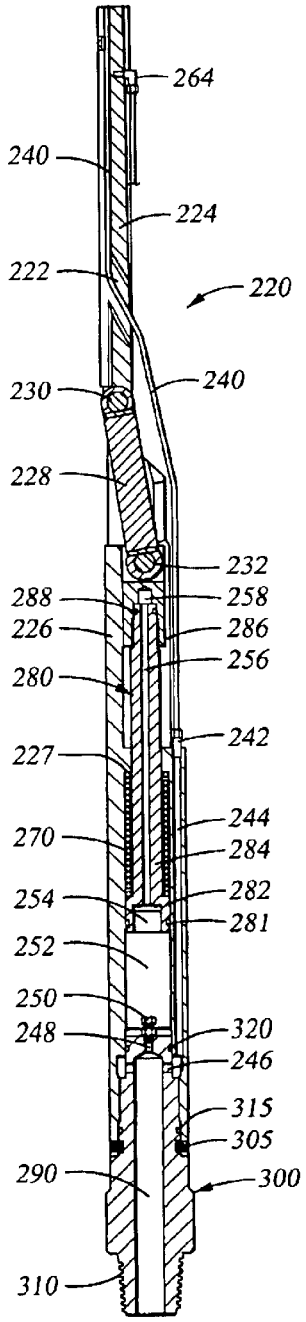
FIGS. 9A, 9B, and 9C depict an alternative actuatable ramp that can be used to guide the mill tool radially outside of the casing after an optimized window that has been cut.
Figure 9B:
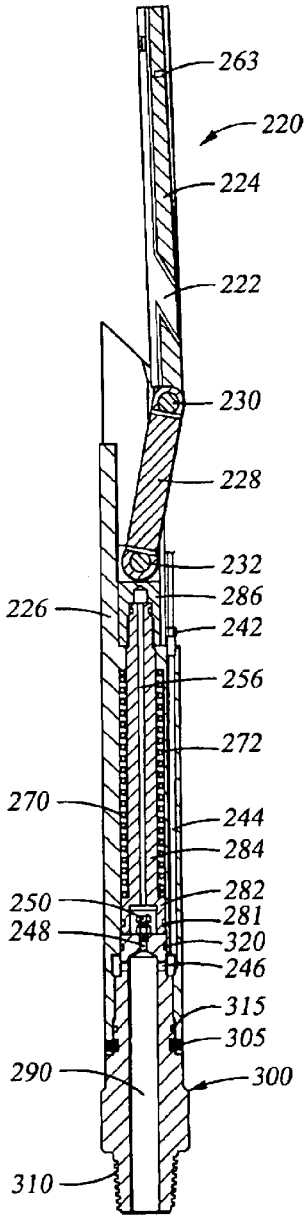
Figure 9C:
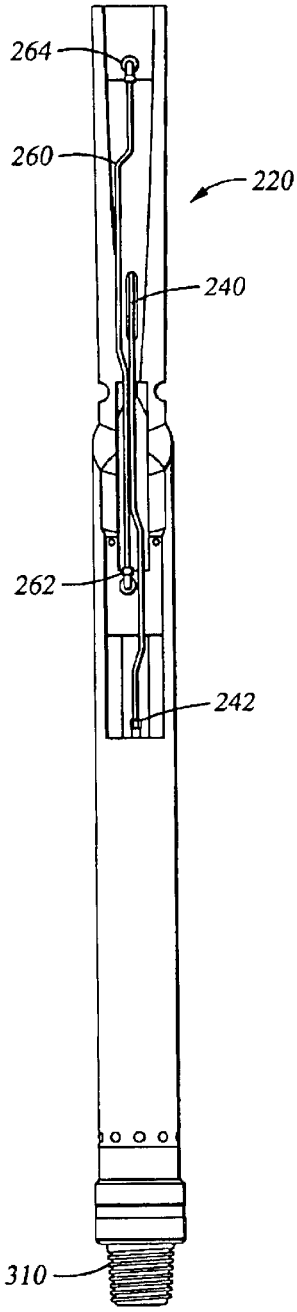

FIGS. 9A–9C depict an alternative embodiment of an actuatable ramp for deviating the mill tool radially outwardly through an optimized window to a location outside of the casing for drilling a rathole. FIG. 9A and FIG. 9B provide cross-sectional side views of the lower end of a whipstock 220 in the non-actuated position and in the actuated position, respectively. FIG. 9C depicts a plan view of hydraulic control lines 240 and 260 that run along the outside of the whipstock end 220. Above the whipstock end 220, the upper portions of the whipstock (not shown) will substantially resemble in construction the whipstock 38 previously described, and will include a maintenance surface 56 to form an angle of approximately 0° with the central axis of the whipstock as previously described. The whipstock end 220 is divided into an upper ramp portion 224 and a lower body portion 226. The upper and lower portions 224, 226 are connected by a linkage 228 that provides a pair of hinge pivot points 230, 232. A bottom sub 300 is connected to the lower end of the whipstock body 226 by torque screws 305, and seals 315, 320. The bottom sub 300 includes a rotary shoulder 310 at its lower end for connecting to another device, such as an anchor/packer (not shown).

Referring first to FIG. 9A and FIG. 9C, an upper hydraulic control line 240 extends from the surface and crosses through an aperture 222 in the upper ramp portion 224 to connect at fitting 242 to a lower hydraulic control line 244 in the body portion 226. The lower control line 244 is in fluid communication through port 246 with a lower bore 290 in the bottom sub 300 that extends downwardly to supply fluid pressure to a hydraulic tool, such as an anchor/packer (not shown), below the whipstock end 220. A passageway 248 leads between the lower bore 290 and a check valve 250 that enables hydraulic flow only upwardly into the whipstock end 220. A spring-loaded piston assembly 280 is provided above the check valve 250 and comprises a base 282, a rod 284, and a plunger 286. The plunger 286 sealingly engages the whipstock body 226 at 281, and the piston rod 284 sealingly engages the piston plunger 286 at 288. A spring 270 is disposed in a spring chamber 272 formed between the piston rod 284 and the whipstock body 226. The spring chamber 272 is bound at its lower end by the piston base 282 and at its upper end by a shoulder 227 of the whipstock body 226. A cavity 254 is provided in the piston base 282, and a hydraulic tube 256 extends through the center of the piston rod 284. A passageway 258 provides fluid communication between the tube 256 and a hydraulic chamber control line 260 that connects to the passageway 258 via an elbow fitting 262. The hydraulic chamber control line 260 extends to the top of the whipstock ramp 224 and connects thereto via a second elbow fitting 264.

Hydraulic fluid from the surface makes a circuit to pressurize the ramp 224 to the non-actuated position shown in FIG. 9A. The hydraulic fluid flows downwardly through upper hydraulic control line 240, through fitting 242, and continuing downwardly through lower hydraulic control line 244. The hydraulic fluid then moves radially through port 246 into lower bore 290 in the sub 300 to actuate a tool below the whipstock 220, such as an anchor/packer (not shown). Once the anchor or other tool is set, the fluid will flow upwardly through the check valve 250 into the cavity 254 in the piston base 282 and upwardly through the hydraulic tube 256 in the piston rod 284. The hydraulic fluid then moves laterally through the passageway 258 and into the chamber control line 260 extending to the top of the ramp 224. Because a closed hydraulic circuit is formed, as hydraulic fluid pressure increases, the spring 270 will be compressed to its uppermost position as shown in FIG. 9A, thereby pushing piston 280 to its uppermost position and forming a pre-charged fluid chamber 252 between the piston base 282 and the check valve 250. As the piston 280 moves upwardly, the piston plunger 286 engages and moves the linkage 228 to its uppermost position, thereby forcing the ramp 224 to the non-actuated position of FIG. 9A.

In operation, a mill tool such as mill 30 will travel along the maintenance surface 56 (not shown) above the whipstock end 220 to form a window in the casing, and upon encountering the elbow fitting 264 will mill the fitting 264 away, thereby releasing the hydraulic pressure in chamber control line 260 and the remainder of the hydraulic circuit. Thus, the hydraulic pressure in pre-charged fluid chamber 252 below piston base 282 will be released to allow the piston 280 to move downwardly to its lowermost position as shown in FIG. 9B in response to the force of spring 270. As the piston 280 moves downwardly, the linkage 228 will move downwardly and outwardly, thereby moving the ramp portion 224 to the actuated position of FIG. 9B. In one embodiment, the actuated ramp 224 will form an angle of approximately 3° from vertical.

The whipstock end 220 of FIGS. 9A and 9B may be run into the borehole in the actuated position of FIG. 9B and then moved to the non-actuated position of FIG. 9A when the hydraulic circuit is pressured up to set a hydraulic tool below the sub 300, such as an anchor/packer. As previously described, by pressuring up the hydraulic circuit, the piston plunger 286 will be forced upwardly against the linkage 228 to force the ramp 224 to the non-actuated position of FIG. 9A, and the check valve 250 will prevent fluid from escaping pre-charged fluid chamber 252, thereby maintaining the piston 280 position. The ramp 224 will remain in the non-actuated position until the elbow fitting 264 is milled away, and then the ramp 224 will actuate by reciprocating outwardly with respect to the lower body portion 226. The mill may have to be raised upwardly to allow the ramp 224 to actuate to the position of FIG. 9B. If the mill 30 should get stuck when the ramp 224 attempts to expand outwardly, the whipstock end 220 can be lifted to compress the spring 270, thereby pushing the piston 280 upwardly. This will in turn force the linkage 228 to start closing the ramp 224 so that the mill can be moved out of the way.

The whipstock end 220 of FIGS. 9A and 9B has the advantage of enabling a rat hole to be drilled in the formation without replacing the whipstock with a standard deflector slide. The maintenance surface 56 is located above the elbow fitting 264 so that the center line of the mill remains inside the casing as a window of optimum width is formed in the casing. When the mill engages the elbow fitting 264 and mills it away, the ramp 224 will open to the actuated position. Then, as the mill moves along the actuated ramp 224, its center line will gradually be directed outwardly into the borehole through the casing window. Thus, when the center line of the mill crosses the casing and the mill begins cutting a rathole into the formation, the center line will not cut steel and the mill will be protected from damage.

It will, of course, be realized that various modifications can be made in the design and operation of the present invention without departing from the spirit thereof. For example, an "optimum" width for a selected window is not necessarily required to be a window of maximum width, but a preselected width. One can determine a desired location for the whipstock maintenance surface with respect to the surrounding casing by calculation, using the techniques described herein. This desired maintenance surface location can be varied based upon what the desired window width is to be. Thus, while principal preferred constructions and modes of operation of the invention have been described herein, in what is now considered to represent the best embodiments, it should be under stood that within the scope of the appended claims, the invention may be practiced otherwise than as specifically illustrated and described.

What is claimed is:

1. A whipstock for guiding a mill tool to cut a resultant window having a length in a casing in a borehole, and for guiding the mill tool through the window to drill a rathole, comprising:

an elongated whipstock body having a longitudinal axis;

said body including a maintenance surface that forms a substantially zero degree angle with said body axis for engaging said mill tool and retaining said mill tool in an optimum cutting position to mill said resultant window having a substantially uniform width along said length;

a hydraulically actuated ramped surface for deviating said mill tool from the optimum cutting position to a position radially outside of said casing to drill said rathole.

2. The whipstock of claim 1 wherein said ramped surface and said whipstock body are interconnected by a linkage.

3. The whipstock of claim 1 wherein said ramped surface moves axially with respect to said whipstock body.

4. The whipstock of claim 1 wherein said ramped surface reciprocates with respect to said whipstock body.

5. The whipstock of claim 4 wherein said ramped surface reciprocates between a first position and a second position with respect to said whipstock body.

6. The whipstock of claim 5 wherein said ramped surface reciprocates to said first position when hydraulic pressure is applied and said ramped surface reciprocates to said second position when hydraulic pressure is released.

7. The whipstock of claim 1 further comprising a piston assembly that reciprocates said ramped surface with respect to said whipstock body.

8. The whipstock of claim 7 wherein said piston assembly reciprocates said ramped surface to an actuated position when hydraulic pressure is applied and reciprocates said ramped surface to a non-actuated position when hydraulic pressure is released.

9. The whipstock of claim 8 further comprising a check valve to hold hydraulic pressure against said piston assembly to maintain said ramped surface in said actuated position.

10. The whipstock of claim 7 wherein said piston assembly is biased by a spring to reciprocate said ramped surface to a non-actuated position when hydraulic pressure is released.

11. The whipstock of claim 1 wherein said optimum cutting position comprises a position wherein an axis of said mill tool is located internally of said casing.

12. A whipstock for forming a resultant window in a casing and drilling a rathole therethrough comprising:

means for deviating a mill tool centerline to a radially optimal cutting position with respect to said casing;

means for maintaining said mill tool centerline in substantially the same radially optimal cutting position while the mill tool is moved longitudinally to form the resultant window; and means for deviating the mill tool centerline through the window to drill a rathole therethrough.

13. A method for forming a resultant window having a longitudinal length in a portion of borehole casing having an axis and a wall and drilling a rathole through the window, the method comprising:

deviating a mill tool radially outwardly to an optimum cutting position with respect to the casing for cutting the casing to form the window having a substantially uniform width along the longitudinal length;

contacting the mill tool with a maintenance surface on a whipstock to maintain the mill tool in the optimum cutting position, the maintenance surface being substantially parallel with the casing axis;

cutting the longitudinal length of the window by moving the mill tool along the maintenance surface;

deviating the mill tool through the window to cut the rathole.

14. The method of claim 13 wherein the operation of deviating the mill tool through the window comprises engaging a hydraulically actuated ramp that reciprocates with respect to the whipstock.

15. The method of claim 14 wherein engaging the ramp causes the ramp to reciprocate from a non-actuated position to an actuated position.

16. The method of claim 15 wherein the ramp is biased to a non-actuated position by hydraulic pressure.

17. The method of claim 14 wherein engaging the ramp releases hydraulic pressure.

18. The method of claim 13 wherein the operation of deviating the mill tool radially outwardly further comprises guiding the mill tool along a sloped surface.

19. The method of claim 13 wherein the optimum cutting position comprises a position wherein an axis of the mill tool is located internally of the casing.

20. The method of claim 13 wherein the maintenance surface has a length substantially equal to the longitudinal length of the window.

21. The method of claim 13 wherein the maintenance surface does not cause the mill tool to be deviated radially outwardly.

22. The method of claim 13 wherein the maintenance surface is formed at a nominal angle of zero degrees with respect to an axis of the whipstock, the nominal angle including manufacturing tolerances.

23. The method of claim 13 wherein the substantially uniform width is less than a maximum width that the mill is capable of cutting.

24. A method for cutting a resultant window in a casing having an axis and for drilling a rathole through the window having a length with parallel sides, comprising:

engaging a mill on a first guide surface to move cutting surfaces on the mill against the casing;

continuing the movement of the mill to cut a top end of the window until the cutting surfaces are in position to cut the parallel sides of the window along the length;

engaging the mill on a second guide surface to guide the mill axially through the casing to cut the parallel sides along the length; and engaging the mill on an actuatable ramp surface to guide the mill through the window to drill the rathole.

25. The method of claim 24 wherein engaging the mill on an actuatable ramp comprises reciprocating the ramp from a non-actuated position to an actuated position.

26. The method of claim 24 wherein the second guide surface retains a centerline of the mill in substantially the same radial position with respect to the axis of the casing.

27. The method of claim 24 wherein the second guide surface has a length substantially equal to the length of the window.

28. The method of claim 24 wherein the parallel sides define a maximum width that the mill is capable of cutting.

* * * * *